United States Patent [19]

Molloy

[11] 4,286,531

[45] Sep. 1, 1981

[54] SEWING APPARATUS

[75] Inventor: Normand Molloy, Arundel, Canada

[73] Assignee: Edward A. Shaw, Montreal, Canada

[21] Appl. No.: 73,607

[22] Filed: Sep. 10, 1979

[51] Int. Cl.[3] ..... D05B 21/00

[52] U.S. Cl. ..... 112/121.15; 112/308

[58] Field of Search ..... 112/121.15, 121.11, 112/121.12, 121.29, 121.14, 308, 309

[56] References Cited

U.S. PATENT DOCUMENTS

| | | | |
|---|---|---|---|
| 2,939,414 | 6/1960 | Slinn | 112/308 |
| 3,072,081 | 1/1963 | Milligan et al. | 112/308 X |
| 3,329,109 | 7/1967 | Portnoff et al. | 112/308 X |
| 3,349,713 | 10/1967 | Bono | 112/121.12 |
| 4,069,778 | 1/1978 | Kozawa | 121/121.12 |

*Primary Examiner*—H. Hampton Hunter

*Attorney, Agent, or Firm*—McFadden Fincham & Co.

[57] ABSTRACT

An apparatus for use in automatically sewing articles along a symmetrical, open-ended path. The articles can be sewn from either end of the path. The apparatus employs a cam means which corresponds to the open-ended path and control means, including a selector valve for automatically driving the cam means in either direction.

9 Claims, 20 Drawing Figures

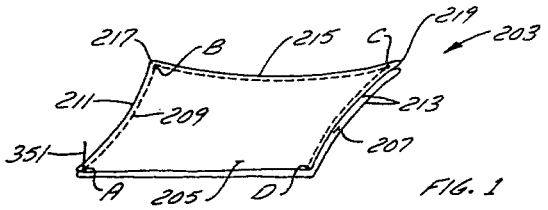
FIG. 1
FIG. 10A
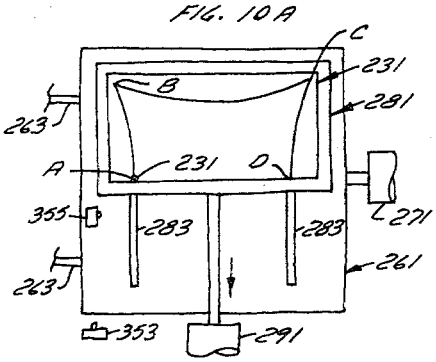
FIG. 10B
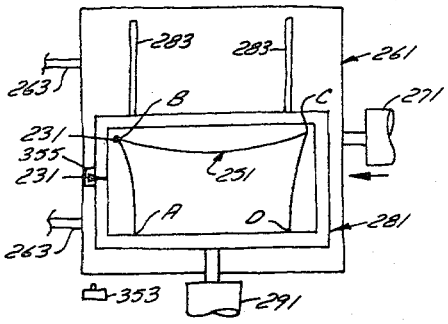
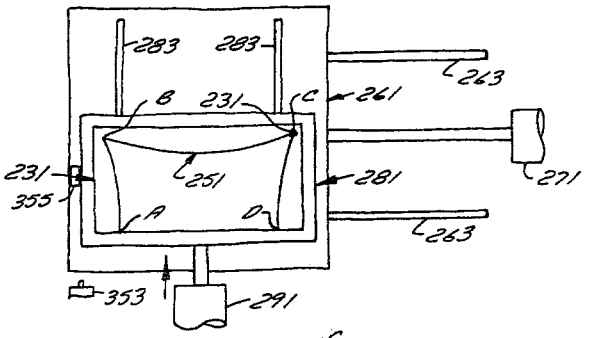
FIG. 10C
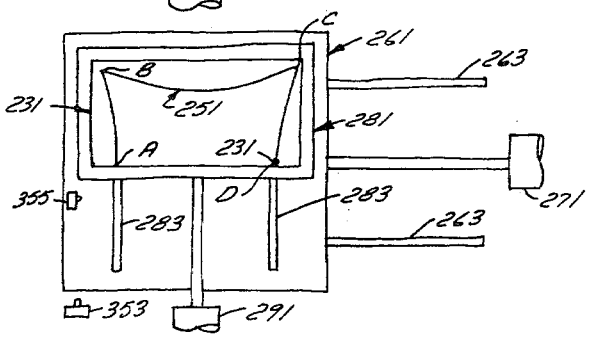
FIG. 10D

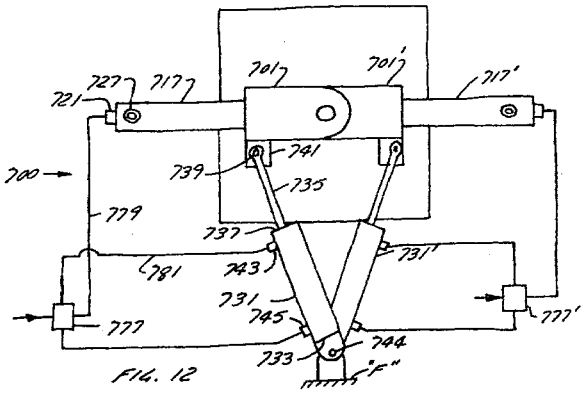
FIG. 12
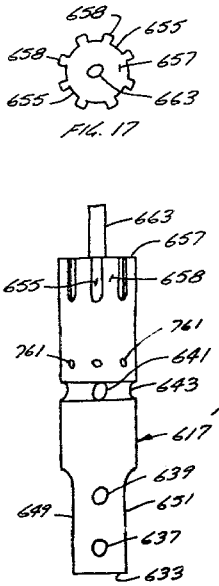
FIG. 15
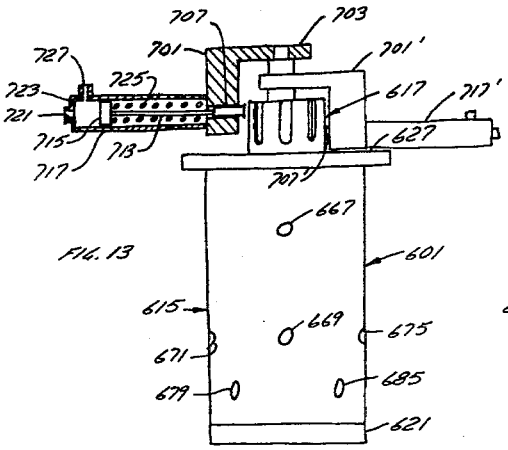
FIG. 13
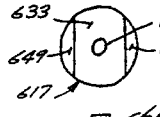
FIG. 16
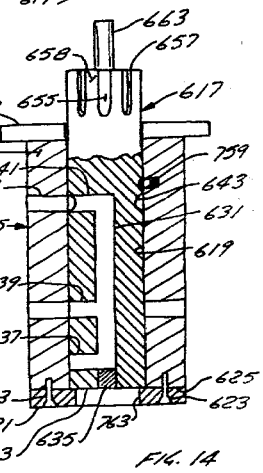
FIG. 14
FIG. 17

SEWING APPARATUS

This invention is directed toward an improved apparatus for use in automatically sewing articles.

The invention is more particularly directed toward an improved apparatus, and components of the improved apparatus, for use in automatically sewing articles along a symmetrical, open-ended path whereby the articles can be sewn from either end of the path.

The sewing of piecework articles such as collars is very time consuming, due to the handling involved. It is known to provide holder means for the articles which holder means can be rapidly guided past a sewing machine needle to sew the article. For fast sewing machines it is known to guide the holder automatically past the sewing machine needle. However the guide means must always be returned to an initial start position ready for the next article to be sewn. This return step slows down the operation and increases wear of the machine.

In order to reduce the time required to sew piecework articles, it is known to provide automatic sewing apparatus which can sew articles along a symmetrical path from either end of the path. Thus, no time need be wasted in returning the machine to a start position. Such apparatus is shown in copending application Ser. No. However, the equipment employed, particularly in sewing articles having a pronounced change of direction in the sewing path, is fairly complicated. In addition, the sewing of articles along a path having several changes in direction can be quite involved.

It is the purpose of the present invention therefore to provide an improved sewing apparatus for use in automatically sewing articles along a sewing path from either end, which apparatus is simple in construction and fast in operation. It is another purpose to provide such an improved apparatus which can more easily sew along paths having abrupt directional changes, and which can more easily handle sewing paths with several directional changes.

In accordance with the present invention, there is provided a guide mechanism for use in sewing articles which guide mechanism allows the articles to be automatically sewn from either end of a symmetrical open-ended sewing path, the guide mechanism employing a unique selector valve structure to accommodate pronounced directional changes, and/or a variety of such directional changes.

The invention is particularly directed toward an apparatus for use in substantially automatically sewing articles along a symmetrical, open-ended path comprising means for mounting each article on a support; means for moving the support to sew along the path from either end of the path to the other end, said support moving means including a first platform mounted for movement along a straight line, a second platform mounted for movement, on the first platform, along a straight line which is perpendicular to the first line, the support fixed to the second platform; first and second fluid operated devices to move the first and second platforms respectively in both directions in their straight line movement; and a hydraulic selector valve to sequentially control the operation of the first and second fluid operated devices.

The invention will now be described in detail having reference to the accompanying drawings in which:

FIG. 1 is a perspective view of a collar;

Figure 11:
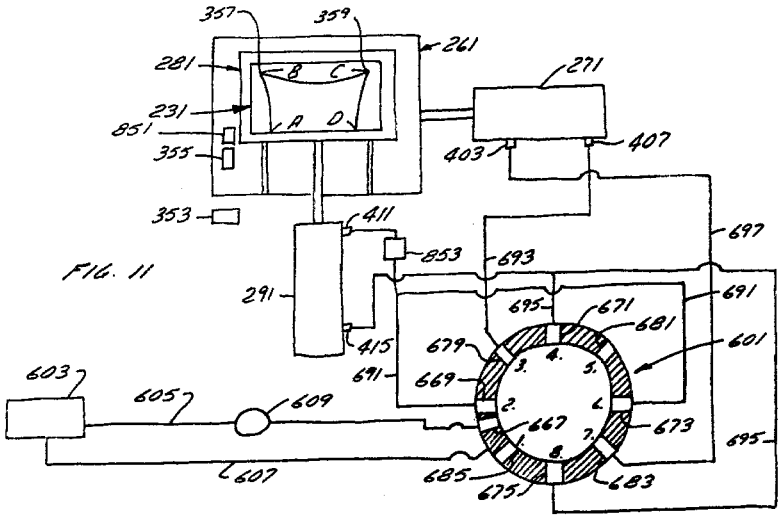
Figure 18:
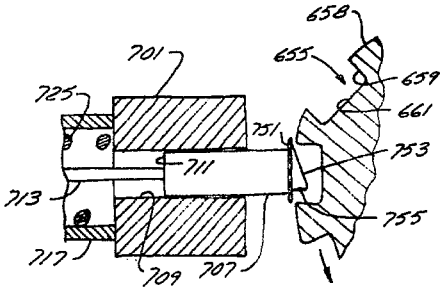
Figure 19:
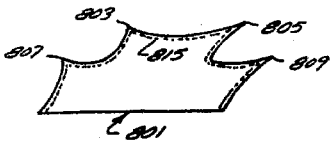
Figure 20:
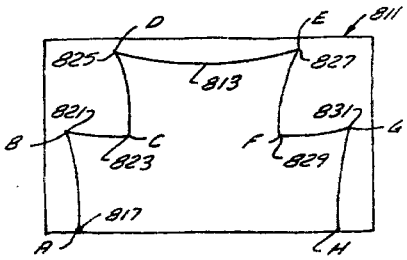

FIG. 10 appearing on the same sheet as FIG. 1 is a schematic set of views showing the operation of the apparatus;

FIG. 11 is a schematic view of the operating control means for the apparatus;

FIG. 12 is a plan view of a rotating mechanism for a selector valve;

FIG. 13 is a partial front elevation view, in partial section, of the selector valve;

FIG. 14 is a cross-section view of the selector valve;

FIG. 15 is a front view of the rotor;

FIG. 16 is a bottom view of the rotor;

FIG. 17 is a top view of the rotor;

FIG. 18 appearing on the same sheet as FIG. 11, is a detail cross-section view of the rotating mechanism;

FIG. 19 appearing on the same sheet as FIG. 11, is a schematic view of another type of collar; and FIG. 20 appearing on the same sheet as FIG. 11, is a plan view of a template for use in sewing the collar shown in FIG. 19.

An apparatus 201 suitable for sewing articles such as shirt collars 203 is shown in FIGS. 2 to 9. The shirt collars 203 to be sewn, shown in FIG. 1, comprise two or more fabric layers 205, 207, cut in the shape shown and adapted to be sewn together along a symmetrical, open-ended path 209 which is close to, and parallels, the side edges 211, 213 and the outer edge 215 of the collar. The side edges 211, 213 are slightly concave. The outer edge 215 is also slightly concave and longer than the side edges 211, 213. The outer edge 215 meets the side edges 211, 213 at the collar points 217, 219. The sewn path 209 follows closely adjacent to edges 211, 213, 215 starting from one end A to a first corner B, adjacent collar point 217, to a second corner C adjacent collar point 219, and to the other end D.

Figure 5:
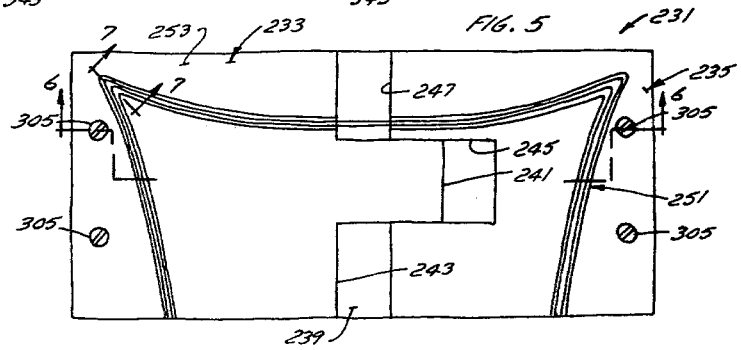
FIG. 5 is a plan view of the collar template.
Figure 6:
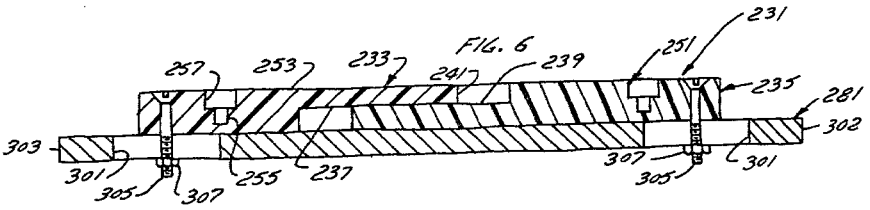
FIG. 6 is a cross-section view taken along line 6—6 of FIG. 5.

The apparatus 201 for use in sewing collars 203 includes a template member 231 which carries symmetrical, open-ended cam guide means corresponding to the path 209 along which the collar is to be sewn. The template 231 can be made in one piece. Preferably, however, it is made in two pieces 233, 235 as shown in FIGS. 5 and 6 which pieces can be moved toward or away from each other to adjust the size of the template 231. One piece 233 has a top portion 237 extending from one side which overlaps a bottom portion 239 extending from the adjacent side of the other piece 235. In addition, the top portion 237 has a rectangular "tongue" section 241 projecting outwardly from the center of its free side 243 which section slides in a mating groove 245 formed in piece 235 extending inwardly from the inner side 247 of the bottom overlap portion 239. The tongue and groove arrangement guide the template pieces 233, 235 in their movement toward or away from each other.

The template 231 carries a cam guide groove 251 which corresponds to the path 209 to be sewn. The groove 251 is cut into the upper surface 253 of the template pieces, and preferably comprises a two-level groove having a deep narrow portion 255 and a wider upper portion 257. The wider upper portion 257 has a depth substantially equal to the thickness of the top overlap portion 237.

Figure 2:
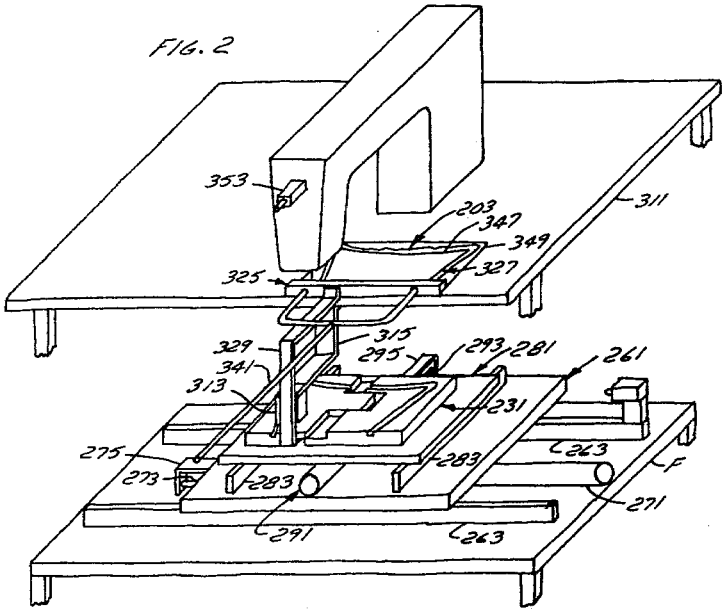
FIG. 2 is a perspective view of apparatus for use in sewing a collar.
Figure 3:
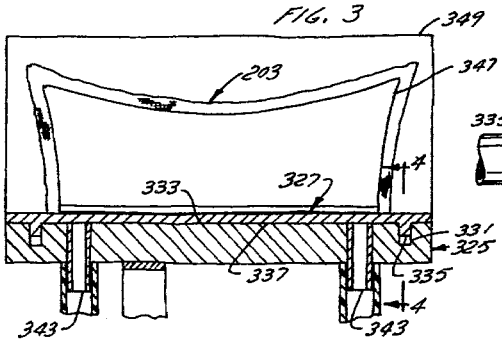
FIG. 3 is a plan view, in partial section, of a collar support and a collar support holder.
Figure 4:
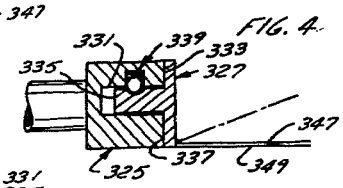
FIG. 4 is a cross-section view taken along line 4—4 of FIG. 3.
Figure 8:
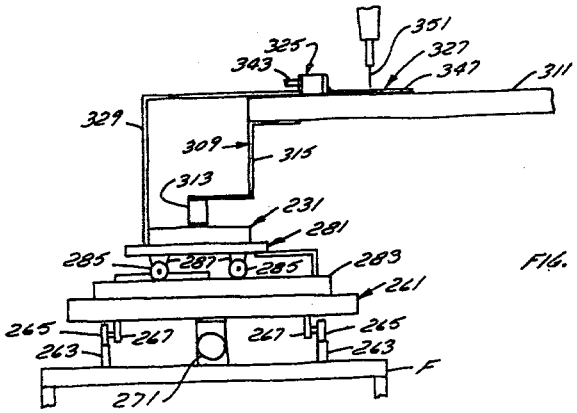
FIG. 8 is an end elevation view of the apparatus.
Figure 9:
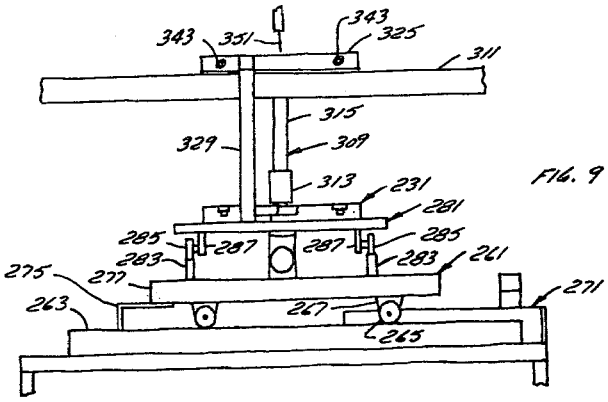
FIG. 9 is a front elevation view of the apparatus.

The apparatus 201 includes as shown in FIGS. 2, 8 and 9, a first support member or platform 261. This first platform 261 comprises a generally rectangular member which is adapted to be movably mounted on a pair of straight rails 263 fastened directly or indirectly to the frame "F" of a sewing machine. The first platform 261 has wheels 265 on brackets 267 which depend from its bottom surface. The wheels 265 run on the rails 263. Means are provided for moving the first platform 261 back and forth along the rails 263. These means can comprise a first fluid-operated piston and cylinder device 271. The fluid-operated device 271 is fixed to the sewing machine frame at one end of the rails. The fluid device 271 can be located beneath the first platform 261, extending parallel to rails 263, and has the free end of its piston rod 273 fixed to a bracket 275 which is attached to one side 277 of first platform 261.

A second support member or platform 281 is mounted on top of the first platform 261. A pair of straight rails 283 are provided on the top surface of platform 261, extending perpendicular to the first rails 263. Second platform 281 has wheels 285 mounted on brackets 287 which depend down from the bottom surface of the platform. The wheels 285 run on the rails 283. Means are provided for moving the second platform 281 back and forth along the rails 283. These moving means comprise a second fluid-operated piston and cylinder device 291. This device 291 is fixed to the first platform between rails 283 and extends under the second platform parallel to rails 283. The free end of the piston rod 293 of the second device is fixed to a bracket 295 which bracket is fixed to the side 297 of the second platform 281. Second fluid-operated device 291 extends perpendicular to the first device 271.

The template 231 is detachably mounted on the top surface of second platform 281, with the template pieces 233, 235 movable toward and away from each other in a line generally parallel to bottom rails 263. Elongated slots 301 are provided in second platform 281, parallel to rails 236. More particularly, a pair of slots 301 are provided near each side edge 302, 303 of the platform. Each template piece carries a pair of bolts 305 for fitting in the slots at either side of the platform. Nuts 307 attach to the bolts 305. When nuts 307 on bolts are loose, the length of the template 231 can be adjusted. When the desired length is obtained, the nuts 307 are tightened on the bolts 305 to fix the template in place.

Cam guide means 309 are fixed to the sewing machine table 311. These guide means 309 comprise a guide pin 313 fastened to a bracket 315 which is fastened to table 311. The pin 313 has a small bottom cylindrical portion 317, which rides in groove portion 255, and a larger top cylindrical portion 319, which rides in groove portion 257, of template 231.

A support 325 for a collar holder 327 is carried by the second platform 281. The support 325 rides on the top surface of sewing machine table 311 and a bracket 329 connects it to second platform 281. The collar holder 327 is adapted to snap on to the support 325 in the proper position. To this end, a pair of recesses 331 are provided in the front face 333 of the support 325. The collar holder 327 has a pair of locating pins 335 projecting from its back wall 337 which fit into recesses 331. A spring-loaded ball detent mechanism 339 retains each pin in the recess. If desired, pressurized air can be directed through a line 341 and a pair of ports 343 passing through support 325 to push the holder 327 off the support 325 when desired. The holder 327 has a hinged cover 347 which clamps the collar plies 205, 207 to be sewn, against a base plate 349.

In operation, a collar 203 to be sewn is mounted in the holder 327 and the holder 327 is mounted in the support 325. When the holder is mounted in the support, the sewing machine needle 351 is located at either position A or position D (see FIG. 1) of the path 209 to be sewn, depending on the position of the first platform 261.

A master switch 353 on the sewing machine is then operated to actuate the second fluid-operated device 291 to move the second platform 281 and thus template 231 past pin 313 from position A on the template to position B as shown in FIG. 10A. As the second platform 281 begins to move it triggers a switch 355 mounted on the first platform 261 which switch initiates operation of the sewing machine. The switch can be adjusted in the direction of rails 283 so as to start sewing at different points along cam track A–B depending on the width of the collars. During movement of the second platform 281, the first platform 261, is free to float back and forth on its rails 263, thus accommodating the concave path A–B.

At position B, (FIG. 10B) suitable switch means stop operation of second device 291 and initiate operation of the first device 271 to move the first platform 261, and thus template 231 past pin 313 from corner position B to corner position C. The second platform 281 is free to float during this movement. At position C, (FIG. 10C) suitable switch means stop operation of the first device 271 and initiate operation of the second device 291 in a reverse direction to its first movement, to move the template from position C to D (FIG. 10D). Movement and sewing stop, the collar is now sewn, and the holder 327 is removed to be replaced by another holder holding another collar to be sewn. The new collar is sewn by moving in a reverse direction through the template groove to the direction moved in sewing the first collar. Thus pin 313 moves from D to C to B to A. The apparatus described above, and the sequence of sewing, is known.

In accordance with the present invention a control system employing a selector valve is used to control the movement of the template 231 as shown in FIGS. 11 to 18. More particularly, the selector valve 601 is used to operate both hydraulic devices 271, 291. The selector valve 601 forms part of a hydraulic system which includes a reservoir 603 for hydraulic fluid, an outlet line 605 leading from the reservoir 603 to the selector valve 601 and a return line 607 from the valve 601 leading back to the reservoir. A pump 609 is provided in outlet line 605 to pump the fluid through the system. If desired, the selector valve 601 could be located directly over the reservoir 603 and hydraulic fluid could be dumped from the valve 601 directly into the reservoir 603, thus dispensing with the return line 607.

The fluid selector valve 601 as shown in FIGS. 13 to 15 has a tubular casing 615 and a generally cylindrical rotor 617 rotatably mounted within the bore 619 of the casing. A circular bottom plate 621 is fastened by suitable fastening means such as screws 623 to the bottom 625 of the casing 615 to retain the rotor 617 within the casing. The rotor 617 projects above the top 627 of the casing 615. The rotor 617 has a central, axial extending bore 631. The bore 631 extends up the center of rotor 617 from its bottom end 633. The bottom end of the bore 631 is closed by a plug 635. Near its bottom end, a first distributing passage 637 extends radially from the bore 631 to the cylindrical surface of the rotor. A second distributing passage 639 is located slightly above the first passage 637 and also extends radially from the bore 631 to the cylindrical surface of the rotor. A receiving passage 641 is located some distance above the second passage 639. This passage 641 also extends radially from bore 631 to the outer surface of the rotor. A channel 643 encircles rotor 617 at the mouth of the passage 641. The rotor 617 has a pair of diametrically opposed cutouts 649, 651 extending up from its bottom end 633. The cutouts 649, 651 form fluid return chambers with the inner surface of bore 619 of the casing when the rotor 617 is inserted into the casing. The cutouts 649, 651 extend up past the second passage 639. The upper end of the rotor 617 is splined with eight equally spaced-apart, grooves 655 extending down from the top end 657 of the rotor to form eight splines 658. Each groove 655 has a shallow U-shaped cross-section with short side walls 659 and a relatively long bottom wall 661 as shown in FIG. 18. A mounting pin 663 projects axially up a short distance from the top end 657 of the rotor.

The casing 615 has a radially extending inlet port 667 in its wall 669 which is aligned with the channel 643 in the rotor. A first set of four equally spaced-apart ports 669, 671, 673 and 675 are provided in the casing wall 669 extending in a circle about casing 615 and at a level to align with first passage 637 in the rotor. A second set of four equally spaced-apart ports 679, 681, 683 and 685 are provided in the casing wall 669 above the first set of ports and aligned with the second passage 639. The second set of ports are staggered between the first set of ports.

The outlet line 605 from the reservoir is connected to inlet port 667 to bring fluid to the selector valve. Port 669 is connected via a line 691 to the front port 411 of second hydraulic device 291. Port 679 is connected via a line 693 to the rear port 407 of first hydraulic device 271. Port 671 is connected via a line 695 to the front port 411 of second hydraulic device 291. Port 681 can be blocked. Port 673 is connected via line 691 to the rear port 415 of second hydraulic device 291. Port 683 is connected via line 697 to the front port 403 of hydraulic device 271. Port 675 is connected via line 695 to the front port 411 of hydraulic device 291. Port 685 can be blocked.

A rotor rotating mechanism 700 is provided for rotating the rotor 617 within the casing 615. The rotating means includes a support block 701 located adjacent the top end of the rotor facing the splines 658. The block 701 has an arm 703 extending therefrom adapted to be rotatably mounted on pin 663 extending up from the top end 657 of the rotor 617. A pin 707 is slidably mounted in a bore 709 in the block, the bore 709 extending radially toward the axis of the rotor 617. The pin 707 is connected at its rear end 711 to one end of piston rod 713. The other end of the piston rod 713 is connected to a piston 715 slidable in a cylinder 717 which is fixed at its front end to block 701. The cylinder 717 is aligned with bore 709. An air inlet 721 is provided at the back end 723 of the cylinder 717. A spring 725 within the cylinder 717 biases the piston 715 toward the back end 723. A vent 727 is provided in the cylinder adjacent the back end 723.

A second air cylinder 731 is provided for use in rotating the rotor 613. The second air cylinder 731 is slightly larger in diameter than first cylinder 717. The second air cylinder 731 is pivotally fixed at its back end 733 to a frame or similar fixed support. The piston rod 735 projecting from the front end 737 of the cylinder is pivotally connected by a pin 739 to a bracket 741 on the block 701. The second cylinder 731 has a front air port 743 and a rear air port 745.

The pin 707 is adapted to be pushed into one of the grooves 655 on the rotor 617 by first air cylinder 717. Operation of the second air cylinder 731, while the pin 707 is in the groove 655 moves the block 701 laterally to rotate the rotor 617 one-eighth of a turn. The pin 707 is provided with a disc 751 at its leading end. A cam element 753 is mounted on the face of the disc 751. The cam element 753 has a triangular wedge shape with the wide side 755 of the wedge facing in the desired direction of rotation.

A spring loaded ball detent 759 is provided in the wall 669 of the casing 615 projecting into the bore 619. A circle of eight, equally spaced-apart, depressions 761 is provided about the rotor 617 for cooperating with the ball detent 759. Each depression 761 positions the passageways 637, 639 in alignment with one of the ports in the two sets of ports in the casing. The base plate 621 preferably has a central hole 763 slightly smaller than the diameter of the rotor 619. The cutouts 649, 651 communicate with hole 763 to return oil directly to the reservoir 603 when the valve 601 is mounted over the reservoir.

Figure 7:
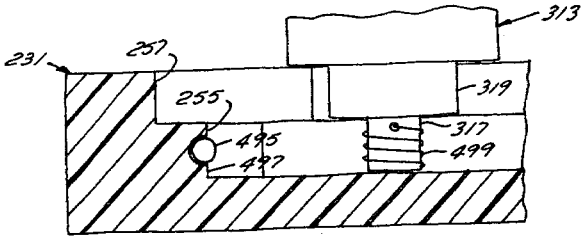
FIG. 7 is a cross-section view taken along line 7—7 of FIG. 5.

The embodiment employing the selector valve 601 is quite simple to operate. The template 231 has first and second switches 357, 359 in the corners B, C. Both switches 357, 359 are the same and as shown in FIG. 7, include a first electrical contact, such as a metal ball 495 positioned in the wall 497 of the lower groove portion 255 in each corner B, C. A wire 499 is wound about the lower portion 317 of pin 313 for making contact with the metal balls 495 as the pin 313 moves into the corners B, C of the groove. The ball 495 and wire 499 are electrically connected into the system by suitable leads (not shown). A master start switch 353 is provided on the sewing machine, as previously indicated. Also, a sewing start-stop switch 355 is provided on the first platform 261 along path A–B, actuated by movement of the second platform 281 as previously indicated. A master stop switch (not shown) is provided on the sewing machine actuated by the thread cutter on the sewing machine.

To start, the master start switch is operated, electrically operating an air valve 777 to pass air to the rear of the small cylinder 717 and to the front of the large air cylinder via lines 779, 781. The piston in the smaller cylinder 717 moves first to insert the pin 707 in a groove 655 and then the larger cylinder 731 pulls the inserted pin 707 toward it to rotate rotor 617 one-eighth turn and move passages 637, 639 from a neutral position 1 at port 685 to a position 2 opposite port 669. At position 2, passage 637 is aligned with port 669 to feed hydraulic fluid through line 691 to device 291 causing the template to move from A to B. Cylinder 291 vents via line 695 to port 671 which communicates with one of the cutouts 649, 651. In moving from A to B, switch 355 is actuated to start sewing. At B, switch 357 operates the air valve 777 to again rotate the rotor one-eighth turn from position 2 to 3. Passage 639 is now aligned with port 679 to feed fluid via line 693 to cylinder 271 causing the template to move from B to C. Cylinder 271 vents through line 697 and port 683 to one of the cutouts 649, 651. At C, switch 359 operates the air valve 777 to rotate rotor 617 from position 3 to 4. Cylinder 291 is now actuated through port 671 and line 695 to move the template from C to D. Cylinder 291 vents via line 691 back to one of the cutouts. In passing from C to D, the stop switch on the thread cutter is operated to stop sewing. After a slight delay, after actuation the switch on the thread cutter operates the air valve 777 to rotate the rotor 617 to neutral position 5. The machine is now ready to sew a second collar but in the reverse direction from D to C to B to A while going through positions 6, 7, 8, 1. At position 7 it is noted that cylinder 271 is fed from port 683 via a new line 697 in order to go from C to B. Thus two collars can be sewn through one revolution of the rotor.

The two sets of ports are provided one above the other in the casing in order to conserve space. This permits the ports to be more closely spaced providing a smaller unit, and also permitting a shorter stroke on the rotor rotating mechanism. The ports could be all arranged in a circle at one level if desired. Then one of the passageways 637, 639 could be dispensed with. The selector valve 601 with slight modification permits double pointed collars or like articles to be sewn if desired. A double-pointed collar 801 is shown in FIG. 19 and has a second set of collar points 803, 805 spaced inwardly and forwardly from the outer regular collar points 807, 809. A template 811 is provided having a cam groove 813 following the path 815 to be sewn on the double point collar 801. The cam pin 817 travels along the groove 813 out from start A to corner B, in along to corner C, out from C to corner D, across from D to corner E, in from E to corner F, out from F to corner G, and in to end H. Switches 821, 823, 825, 827, 829 and 831 are provided at corners B, C, D, E, F and G respectively. These switches have the same construction as switches 357, 359 previously described.

A second rotor rotating mechanism 700' is provided substantially identical to the first rotor mechanism but reversed with respect to it. Thus pin 707' of the second rotor mechanism is located diametrically opposite pin 707 and is positioned to rotate the rotor in the opposite clockwise direction to the counterclockwise direction of rotation imparted by pin 707. Pin 707' is mounted in a block 701' and is adapted to be pushed into a groove 655 by a first air cylinder 717' diametrically opposed to cylinder 717. A larger air cylinder 731', similar to cylinder 731, extends from block 701' to pin 744 pivoting cylinder 731 to frame "F." Thus both large air cylinders 731, 731' are pinned at one end at the same location. Operation of cylinder 731' with pin 707' inserted in a groove, will rotate the rotor counterclockwise.

Switch 823 and switch 829 control operation of an air valve 777' controlling operation of cylinders 717', 731'. In operation, sewing a double point collar, the master switch and sewing switch operate as before with switch 821 operating in the same manner as switch 357. When the pin reaches switch 823, cylinders 717', 731' are actuated to rotate the rotor back from port 679, to 669 to move from C to D. At D, switch 825 actuates cylinders 717, 731 to again move from port 669 to port 679 and to sew along D to E. At E, switch 827 rotates rotor from port 679 to 671 via cylinders 717, 731. At F however, switch 829 causes cylinders 717', 731' to rotate the rotor back to port 679 to sew from F to G. At G, switch 831 moves the rotor back to port 671 to finish sewing from G to H.

Other types of patterns could be readily sewn incorporating the selector valve with two rotating mechanisms. Ports 685, 681 have been described as being plugged up but they can be utilized to provide additional movements.

In all the embodiments described, the cylinder devices move at a constant speed while the stitch length can vary either due to traversing curves or due to a slow start up. In either case, means to provide a speed adjustment can be incorporated in the machine to obtain stitching which is more uniform in length. The adjustment means can include a line restrictor constructed to restrict fluid flow to the operating cylinder for a predetermined period of time during the time when the stitch length varies. Thus, in travelling from A to B to stitch a collar, the sewing machine is started up at some point along this path by switch 355. The sewing machine, due to inertia, starts slowly and initially the stitches made are too long. To overcome this, a second switch 851 (FIG. 11) is placed just prior to switch to actuate a restrictor 853 on line 691 feeding cylinder 291. The restrictor 853 (of known construction) slows down the movement of the platform 281 for a short period of time until the sewing machine is running at full speed. Thus the initial stitch length is shortened to a desired length when full running speed is reached, the restrictor 853 cuts out.

The embodiments of the invention in which an exclusive property or privilege is claimed are defined as follows:

1. An apparatus for use in substantially automatically sewing articles along a symmetrical, open-ended path comprising means for mounting each article on a support; means for moving the support to sew along the path from either end of the path to the other end, said support moving means including a first platform mounted for movement along a straight line, a second platform mounted for movement, on the first platform, along a straight line which is perpendicular to the first line, the support fixed to the second platform; first and second fluid operated devices to move the first and second platforms respectively in both directions in their straight line movement; and a hydraulic selector valve to sequentially control the operation of the first and second fluid operated devices.

2. An apparatus as claimed in claim 1 including template means having a cam surface corresponding to the path to be sewn, means for detachably mounting the template on the second platform, and a fixed cam member adjacent the cam surface.

3. An apparatus as claimed in claim 2 wherein the cam surface on the template comprises a groove in its top surface, and the fixed cam member comprises a pin projecting into the groove.

4. An apparatus as claimed in claim 3 including at least one switch means in the groove where a substantial change of direction occurs, the switch means operable to initiate operation of one of the two fluid-operated devices while terminating operation of the other of the devices.

5. An apparatus as claimed in claim 4 wherein the selector valve comprises a cylindrical casing having ports connected with the fluid-operated devices, and a rotor rotatable within the casing to selectively direct fluid to the ports.

6. An apparatus as claimed in claim 5 including means on the rotor for directing fluid to a selected port from a fluid supply, and separate means for receiving fluid from the devices for return to the fluid supply.

7. An apparatus as claimed in claim 6 including means for rotating the rotor in increments in either direction.

8. An apparatus as claimed in claim 7, wherein the rotating means includes means selectively connected to the rotor, and means for transversely moving the connecting means while connected to the rotor to rotate the rotor.

9. An apparatus as claimed in claim 8, wherein the connecting means comprises a pin movable radially into one of a series of grooves located circumferentially about the rotor.

* * * * *